US007816001B2

(12) United States Patent
Pohlmann

(10) Patent No.: US 7,816,001 B2
(45) Date of Patent: Oct. 19, 2010

(54) INSULATION BOARD MADE OF A MIXTURE OF WOOD BASE MATERIAL AND BINDING FIBERS

(75) Inventor: Cevin Marc Pohlmann, Hoisdorf (DE)

(73) Assignee: Kronotec AG, Lucerne (CH)

( * ) Notice: Subject to any disclaimer, the term of this patent is extended or adjusted under 35 U.S.C. 154(b) by 48 days.

(21) Appl. No.: 12/143,229

(22) Filed: Jun. 20, 2008

(65) Prior Publication Data

US 2009/0142611 A1 Jun. 4, 2009

Related U.S. Application Data

(63) Continuation of application No. 11/076,044, filed on Mar. 10, 2005, now Pat. No. 7,550,202.

(30) Foreign Application Priority Data

Mar. 11, 2004 (DE) ..... 10 2004 011 931

(51) Int. Cl.
*B32B 5/16* (2006.01)
*D03D 15/00* (2006.01)

(52) U.S. Cl. ..... 428/323; 428/402; 428/407; 428/537.1; 106/262; 106/282; 523/201; 264/122; 427/212; 427/408

(58) Field of Classification Search ..... 428/402, 428/403, 531.1; 523/201; 106/262; 264/122
See application file for complete search history.

(56) References Cited

U.S. PATENT DOCUMENTS

| | | | |
|---|---|---|---|
| 213,740 | A | 4/1879 | Conner |
| 623,562 | A | 4/1899 | Rider |
| 714,987 | A | 12/1902 | Wolfe |
| 753,791 | A | 3/1904 | Fulghum |
| 1,124,228 | A | 1/1915 | Houston |
| 1,407,679 | A | 2/1922 | Ruthrauff |
| 1,454,250 | A | 5/1923 | Parsons |
| 1,468,288 | A | 9/1923 | Een |

(Continued)

FOREIGN PATENT DOCUMENTS

| | | |
|---|---|---|
| AT | 005566 | 8/2002 |

(Continued)

OTHER PUBLICATIONS

Webster Dictionary, p. 862.

(Continued)

*Primary Examiner*—Callie E Shosho
*Assistant Examiner*—Ronak Patel
(74) *Attorney, Agent, or Firm*—Andrew M. Calderon; Roberts Mlotkowski Safran & Cole, P.C.

(57) ABSTRACT

The invention relates to an insulation material board composed of a wood material/binder fiber mixture and to a method for producing an insulation material board, in which an additive with a thermally resistant core and with a thermally activatable coating is added to the mixture, and the thermally activatable coating is activated by the supply of heat. An insulation material board may be composed of a wood material/binder mixture, including an additive having thermosetting and thermoplastic portions, wherein the thermosetting portion is a thermosetting plastic that forms a core and the thermoplastic portion forms a thermally activatable coating that at least partially encloses the core.

10 Claims, 1 Drawing Sheet

U.S. PATENT DOCUMENTS

| | | | |
|---|---|---|---|
| 1,477,813 | A | 12/1923 | Daniels |
| 1,510,924 | A | 10/1924 | Daniels et al. |
| 1,540,128 | A | 6/1925 | Houston |
| 1,575,821 | A | 3/1926 | Daniels |
| 1,602,256 | A | 10/1926 | Sellin |
| 1,602,267 | A | 10/1926 | Karwisch |
| 1,615,096 | A | 1/1927 | Meyers |
| 1,622,103 | A | 3/1927 | Fulton |
| 1,622,104 | A | 3/1927 | Fulton |
| 1,637,634 | A | 8/1927 | Carter |
| 1,644,710 | A | 10/1927 | Crooks |
| 1,660,480 | A | 2/1928 | Daniels |
| 1,714,738 | A | 5/1929 | Smith |
| 1,718,702 | A | 6/1929 | Pfiester |
| 1,734,826 | A | 11/1929 | Pick |
| 1,764,331 | A | 6/1930 | Moratz |
| 1,776,188 | A | 9/1930 | Langb'aum |
| 1,778,069 | A | 10/1930 | Fetz |
| 1,779,729 | A | 10/1930 | Bruce |
| 1,787,027 | A | 12/1930 | Wasleff |
| 1,823,039 | A | 9/1931 | Gruner |
| 1,859,667 | A | 5/1932 | Gruner |
| 1,898,364 | A | 2/1933 | Gynn |
| 1,906,411 | A | 5/1933 | Potvin |
| 1,921,164 | A | 8/1933 | Lewis |
| 1,929,871 | A | 10/1933 | Jones |
| 1,940,377 | A | 12/1933 | Storm |
| 1,946,648 | A | 2/1934 | Taylor |
| 1,953,306 | A | 4/1934 | Moratz |
| 1,986,739 | A | 1/1935 | Mitte |
| 1,988,201 | A | 1/1935 | Hall |
| 2,023,066 | A | 12/1935 | Curtis et al. |
| 2,044,216 | A | 6/1936 | Klages |
| 2,065,525 | A | 12/1936 | Hamilton |
| 2,123,409 | A | 7/1938 | Elmendorf |
| 2,220,606 | A | 11/1940 | Malarkey et al. |
| 2,276,071 | A | 3/1942 | Scull |
| 2,280,071 | A | 4/1942 | Hamilton |
| 2,324,628 | A | 7/1943 | Kähr |
| 2,328,051 | A | 8/1943 | Bull |
| 2,398,632 | A | 4/1946 | Frost et al. |
| 2,430,200 | A | 11/1947 | Wilson |
| 2,740,167 | A | 4/1956 | Rowley |
| 2,894,292 | A | 7/1959 | Gramelspacker |
| 3,045,294 | A | 7/1962 | Livezey, Jr. |
| 3,100,556 | A | 8/1963 | De Ridder |
| 3,125,138 | A | 3/1964 | Bolenbach |
| 3,182,769 | A | 5/1965 | De Ridder |
| 3,203,149 | A | 8/1965 | Soddy |
| 3,204,380 | A | 9/1965 | Smith et al. |
| 3,267,630 | A | 8/1966 | Omholt |
| 3,282,010 | A | 11/1966 | King, Jr. |
| 3,310,919 | A | 3/1967 | Bue et al. |
| 3,347,048 | A | 10/1967 | Brown et al. |
| 3,460,304 | A | 8/1969 | Braeuninger et al. |
| 3,481,810 | A | 12/1969 | Waite |
| 3,526,420 | A | 9/1970 | Brancaleone |
| 3,538,665 | A | 11/1970 | Gohner |
| 3,553,919 | A | 1/1971 | Omholt |
| 3,555,762 | A | 1/1971 | Costanzo, Jr. |
| 3,608,258 | A | 9/1971 | Spratt |
| 3,694,983 | A | 10/1972 | Couquet |
| 3,714,747 | A | 2/1973 | Curran |
| 3,720,027 | A | 3/1973 | Christensen |
| 3,731,445 | A | 5/1973 | Hoffmann et al. |
| 3,759,007 | A | 9/1973 | Thiele |
| 3,760,548 | A | 9/1973 | Sauer et al. |
| 3,768,846 | A | 10/1973 | Hensley et al. |
| 3,859,000 | A | 1/1975 | Webster |
| 3,878,030 | A | 4/1975 | Cook |
| 3,902,293 | A | 9/1975 | Witt et al. |
| 3,908,053 | A | 9/1975 | Hettich |
| 3,936,551 | A | 2/1976 | Elmendorf et al. |
| 3,988,187 | A | 10/1976 | Witt et al. |
| 4,006,048 | A | 2/1977 | Cannady, Jr. et al. |
| 4,044,087 | A | 8/1977 | Robitschek et al. |
| 4,090,338 | A | 5/1978 | Bourgade |
| 4,091,136 | A | 5/1978 | O'Brian et al. |
| 4,099,358 | A | 7/1978 | Compaan |
| 4,118,533 | A | 10/1978 | Hipchen et al. |
| 4,131,705 | A | 12/1978 | Kubinsky |
| 4,164,832 | A | 8/1979 | Van Zandt |
| 4,169,688 | A | 10/1979 | Toshio |
| 4,242,390 | A | 12/1980 | Nemeth |
| 4,243,716 | A | 1/1981 | Kosaka et al. |
| 4,245,689 | A | 1/1981 | Grard et al. |
| 4,246,310 | A | 1/1981 | Hunt et al. |
| 4,290,248 | A | 9/1981 | Kemerer et al. |
| 4,299,070 | A | 11/1981 | Oltmanns et al. |
| 4,426,820 | A | 1/1984 | Terbrack et al. |
| 4,431,044 | A | 2/1984 | Bruneau |
| 4,471,012 | A | 9/1984 | Maxwell |
| 4,501,102 | A | 2/1985 | Knowles |
| 4,561,233 | A | 12/1985 | Harter et al. |
| 4,585,685 | A | 4/1986 | Forry et al. |
| 4,612,745 | A | 9/1986 | Hovde |
| 4,641,469 | A | 2/1987 | Wood |
| 4,653,242 | A | 3/1987 | Ezard |
| 4,654,244 | A | 3/1987 | Eckert et al. |
| 4,703,597 | A | 11/1987 | Eggemar |
| 4,715,162 | A | 12/1987 | Brightwell |
| 4,738,071 | A | 4/1988 | Ezard |
| 4,752,497 | A | 6/1988 | McConkey et al. |
| 4,769,963 | A | 9/1988 | Meyerson |
| 4,819,932 | A | 4/1989 | Trotter, Jr. |
| 4,831,806 | A | 5/1989 | Niese et al. |
| 4,845,907 | A | 7/1989 | Meek |
| 4,905,442 | A | 3/1990 | Daniels |
| 4,947,602 | A | 8/1990 | Pollasky |
| 5,029,425 | A | 7/1991 | Bogataj |
| 5,103,614 | A | 4/1992 | Kawaguchi et al. |
| 5,113,632 | A | 5/1992 | Hanson |
| 5,117,603 | A | 6/1992 | Weintraub |
| 5,136,823 | A | 8/1992 | Pellegrino |
| 5,165,816 | A | 11/1992 | Parasin |
| 5,179,812 | A | 1/1993 | Itill |
| 5,205,091 | A | 4/1993 | Brown |
| 5,216,861 | A | 6/1993 | Meyerson |
| 5,251,996 | A | 10/1993 | Hiller et al. |
| 5,253,464 | A | 10/1993 | Nilsen |
| 5,283,102 | A | 2/1994 | Sweet et al. |
| 5,295,341 | A | 3/1994 | Kajiwara |
| 5,335,473 | A | 8/1994 | Chase |
| 5,348,778 | A | 9/1994 | Knipp et al. |
| 5,349,796 | A | 9/1994 | Meyerson |
| 5,390,457 | A | 2/1995 | Sjölander |
| 5,413,834 | A | 5/1995 | Hunter et al. |
| 5,433,806 | A | 7/1995 | Pasquali et al. |
| 5,474,831 | A | 12/1995 | Nystrom |
| 5,489,655 | A * | 2/1996 | Shimoda et al. ..... 525/462 |
| 5,497,589 | A | 3/1996 | Porter |
| 5,502,939 | A | 4/1996 | Zadok et al. |
| 5,540,025 | A | 7/1996 | Takehara et al. |
| 5,567,497 | A | 10/1996 | Zegler et al. |
| 5,570,554 | A | 11/1996 | Searer |
| 5,597,024 | A | 1/1997 | Bolyard et al. |
| 5,630,304 | A | 5/1997 | Austin |
| 5,653,099 | A | 8/1997 | MacKenzie |
| 5,660,926 | A * | 8/1997 | Skowronski et al. ..... 428/314.4 |
| 5,671,575 | A | 9/1997 | Wu |
| 5,688,583 | A * | 11/1997 | Asai et al. ..... 428/200 |
| 5,694,734 | A | 12/1997 | Cercone et al. |
| 5,706,621 | A | 1/1998 | Pervan |
| 5,736,227 | A | 4/1998 | Sweet et al. |

5,749,954 A 5/1998 Law et al.
5,768,850 A 6/1998 Chen
5,797,175 A 8/1998 Schneider
5,797,237 A 8/1998 Finkell, Jr.
5,823,240 A 10/1998 Bolyard et al.
5,827,592 A 10/1998 Van Gulik et al.
5,860,267 A 1/1999 Pervan
5,935,668 A 8/1999 Smith
5,943,239 A 8/1999 Shamblin et al.
5,953,878 A 9/1999 Johnson
5,968,625 A 10/1999 Hudson
5,985,397 A 11/1999 Witt et al.
5,987,839 A 11/1999 Hamar et al.
6,006,486 A 12/1999 Moriau et al.
6,023,907 A 2/2000 Pervan
6,065,262 A 5/2000 Motta
6,094,882 A 8/2000 Pervan
6,101,778 A 8/2000 Martensson
6,119,423 A 9/2000 Costantino
6,134,854 A 10/2000 Stanchfield
6,148,884 A 11/2000 Bolyard et al.
6,168,866 B1 1/2001 Clark
6,182,410 B1 2/2001 Pervan
6,186,703 B1 2/2001 Shaw
6,205,639 B1 3/2001 Pervan
6,209,278 B1 4/2001 Tychsen
6,216,403 B1 4/2001 Belbeoc'h
6,216,409 B1 4/2001 Roy et al.
D442,296 S 5/2001 Külik
D442,297 S 5/2001 Külik
D442,298 S 5/2001 Külik
D442,706 S 5/2001 Külik
D442,707 S 5/2001 Külik
6,224,698 B1 5/2001 Endo
6,238,798 B1 5/2001 Kang et al.
6,247,285 B1 6/2001 Moebus
D449,119 S 10/2001 Külik
D449,391 S 10/2001 Külik
D449,392 S 10/2001 Külik
6,324,803 B1 12/2001 Pervan
6,345,481 B1 2/2002 Nelson
6,363,677 B1 4/2002 Chen et al.
6,397,547 B1 6/2002 Martensson
6,418,683 B1 7/2002 Martensson et al.
6,421,970 B1 7/2002 Martensson et al.
6,427,408 B1 8/2002 Krieger
6,436,159 B1 8/2002 Safta et al.
6,438,919 B1 8/2002 Knauseder
6,446,405 B1 9/2002 Pervan
6,449,913 B1 9/2002 Shelton
6,449,918 B1 9/2002 Nelson
6,453,632 B1 9/2002 Huang
6,458,232 B1 10/2002 Valentinsson
6,460,306 B1 10/2002 Nelson
6,461,636 B1 10/2002 Arth et al.
6,465,046 B1 10/2002 Hansson et al.
6,490,836 B1 12/2002 Moriau et al.
6,497,961 B2 12/2002 Kang et al.
6,510,665 B2 1/2003 Pervan
6,516,579 B1 2/2003 Pervan
6,517,935 B1 2/2003 Kornfalt et al.
6,519,912 B1 2/2003 Eckmann et al.
6,521,314 B2 2/2003 Tychsen
6,532,709 B2 3/2003 Pervan
6,533,855 B1 3/2003 Gaynor et al.
6,536,178 B1 3/2003 Pålsson et al.
6,546,691 B2 4/2003 Leopolder
6,553,724 B1 4/2003 Bigler
6,558,754 B1 5/2003 Velin et al.
6,565,919 B1 5/2003 Hansson et al.
6,569,272 B2 5/2003 Tychsen
6,588,166 B2 7/2003 Martensson et al.
6,591,568 B1 7/2003 Palsson
6,601,359 B2 8/2003 Olofsson
6,606,834 B2 8/2003 Martensson et al.
6,617,009 B1 9/2003 Chen et al.
6,635,174 B1 10/2003 Berg et al.
6,641,629 B2 11/2003 Safta et al.
6,646,088 B2 11/2003 Fan et al.
6,647,690 B1 11/2003 Martensson
6,649,687 B1 11/2003 Gheewala et al.
6,659,097 B1 12/2003 Houston
6,672,030 B2 1/2004 Schulte
6,675,545 B2 1/2004 Chen et al.
6,681,820 B2 1/2004 Olofsson
6,682,254 B1 1/2004 Olofsson et al.
6,685,993 B1 2/2004 Hansson et al.
6,711,864 B2 3/2004 Erwin
6,711,869 B2 3/2004 Tychsen
6,715,253 B2 4/2004 Pervan
6,723,438 B2 4/2004 Chang et al.
6,729,091 B1 5/2004 Martensson
6,745,534 B2 6/2004 Kornfalt
6,761,008 B2 7/2004 Chen et al.
6,761,794 B2 7/2004 Mott et al.
6,763,643 B1 7/2004 Martensson
6,766,622 B1 7/2004 Thiers
6,769,217 B2 8/2004 Nelson
6,769,218 B2 8/2004 Pervan
6,769,835 B2 8/2004 Stridsman
6,772,568 B2 8/2004 Thiers et al.
6,786,019 B2 9/2004 Thiers
6,803,109 B2 10/2004 Qiu et al.
6,805,951 B2 10/2004 Kornfält et al.
6,823,638 B2 11/2004 Stanchfield
6,833,188 B2 * 12/2004 Semmens ..... 428/361
6,841,023 B2 1/2005 Mott
2001/0029720 A1 10/2001 Pervan
2001/0034992 A1 11/2001 Pletzer et al.
2002/0007608 A1 1/2002 Pervan
2002/0007609 A1 1/2002 Pervan
2002/0014047 A1 2/2002 Thiers
2002/0020127 A1 2/2002 Thiers et al.
2002/0046528 A1 4/2002 Pervan et al.
2002/0056245 A1 5/2002 Thiers
2002/0106439 A1 8/2002 Cappelle
2002/0160680 A1 10/2002 Laurence et al.
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0033777 A1 2/2003 Thiers et al.
2003/0033784 A1 2/2003 Pervan
2003/0115812 A1 6/2003 Pervan
2003/0115821 A1 6/2003 Pervan
2003/0134556 A1 * 7/2003 Christie et al. ..... 442/327
2003/0159385 A1 8/2003 Thiers
2003/0167717 A1 9/2003 Garcia
2003/0196405 A1 10/2003 Pervan
2003/0205013 A1 11/2003 Garcia
2003/0233809 A1 12/2003 Pervan
2004/0014382 A1 * 1/2004 MacAulay ..... 442/23
2004/0016196 A1 1/2004 Pervan
2004/0035078 A1 2/2004 Pervan
2004/0092006 A1 5/2004 Lindekens et al.
2004/0105994 A1 6/2004 Lu et al.
2004/0139678 A1 7/2004 Pervan
2004/0159066 A1 8/2004 Thiers et al.
2004/0177584 A1 9/2004 Pervan
2004/0200165 A1 10/2004 Garcia et al.
2004/0206036 A1 10/2004 Pervan
2004/0237447 A1 12/2004 Thiers et al.
2004/0237448 A1 12/2004 Thiers et al.
2004/0241374 A1 12/2004 Thiers et al.
2004/0244322 A1 12/2004 Thiers et al.

| | | | |
|---|---|---|---|
| 2004/0250493 | A1 | 12/2004 | Thiers et al. |
| 2004/0255541 | A1 | 12/2004 | Thiers et al. |
| 2004/0258907 | A1 | 12/2004 | Kornfalt et al. |
| 2005/0003149 | A1 | 1/2005 | Kornfalt et al. |
| 2005/0016099 | A1 | 1/2005 | Thiers |

FOREIGN PATENT DOCUMENTS

| | | |
|---|---|---|
| AU | 713628 | 5/1998 |
| AU | 200 020703 | 1/2000 |
| BE | 417526 | 9/1936 |
| BE | 557844 | 6/1957 |
| BE | 557844 | 3/1960 |
| BE | 09 600527 | 6/1998 |
| BE | 09 700344 | 10/1998 |
| CA | 991373 | 6/1976 |
| CA | 2226286 | 12/1997 |
| CA | 2252791 | 5/1999 |
| CA | 2289309 | 7/2000 |
| CH | 200949 | 1/1939 |
| CH | 211877 | 1/1941 |
| CH | 562377 | 5/1975 |
| DE | 314207 | 6/1919 |
| DE | 531989 | 8/1931 |
| DE | 740235 | 10/1943 |
| DE | 1 0899696 | 9/1960 |
| DE | 1089966 | 9/1960 |
| DE | 1534278 | 2/1966 |
| DE | 1212225 | 3/1966 |
| DE | 1212275 | 3/1966 |
| DE | 1534802 | 4/1970 |
| DE | 7102476 | 6/1971 |
| DE | 2007129 | 9/1971 |
| DE | 1534278 | 11/1971 |
| DE | 2106690 | 9/1972 |
| DE | 2252643 | 10/1972 |
| DE | 2238660 | 2/1974 |
| DE | 7402354 | 5/1974 |
| DE | 2448319 | 4/1976 |
| DE | 2502992 | 7/1976 |
| DE | 2616077 | 10/1977 |
| DE | 2 917025 | 11/1980 |
| DE | 2917025 | 11/1980 |
| DE | 7911924 | 3/1981 |
| DE | 7928703 | 5/1981 |
| DE | 3041781 | 6/1982 |
| DE | 3214207 | 11/1982 |
| DE | 8226153 | 1/1983 |
| DE | 3343601 | 6/1985 |
| DE | 86 040049 | 6/1986 |
| DE | 3512204 | 10/1986 |
| DE | 3246376 | 2/1987 |
| DE | 4 004891 | 9/1990 |
| DE | 4004891 | 9/1990 |
| DE | 4002547 | 8/1991 |
| DE | 4134452 | 4/1993 |
| DE | 4215273 | 11/1993 |
| DE | 4242530 | 6/1994 |
| DE | 4011656 | 1/1995 |
| DE | 4324137 | 1/1995 |
| DE | 4107151 | 2/1995 |
| DE | 29 517128 | 2/1996 |
| DE | 4242530 | 9/1996 |
| DE | 3544845 | 12/1996 |
| DE | 29 710175 | 9/1997 |
| DE | 19 616510 | 3/1998 |
| DE | 19 651149 | 6/1998 |
| DE | 19 709641 | 9/1998 |
| DE | 19 718319 | 11/1998 |
| DE | 19 735189 | 6/2000 |
| DE | 20001225 | 8/2000 |
| DE | 19 925248 | 12/2000 |
| DE | 20 017461 | 3/2001 |
| DE | 20 018284 | 3/2001 |
| DE | 1 0022008 | 11/2001 |
| DE | 1 0056829 | 6/2002 |
| DE | 20 206460 | 8/2002 |
| DE | 20 218331 | 5/2004 |
| EP | 0 248127 | 12/1987 |
| EP | 0248127 | 12/1987 |
| EP | 0623724 | 11/1994 |
| EP | 0652340 | 5/1995 |
| EP | 0667936 | 8/1995 |
| EP | 0690185 | 1/1996 |
| EP | 0849416 | 6/1998 |
| EP | 0698162 | 9/1998 |
| EP | 0903451 | 3/1999 |
| EP | 0855482 | 12/1999 |
| EP | 0 969164 | 1/2000 |
| EP | 0877130 | 1/2000 |
| EP | 0969163 | 1/2000 |
| EP | 0969164 | 1/2000 |
| EP | 0974713 | 1/2000 |
| EP | 1038898 | 9/2000 |
| EP | 0843763 | 10/2000 |
| EP | 1200690 | 5/2002 |
| EP | 0958441 | 7/2003 |
| EP | 1026341 | 8/2003 |
| ES | 163421 | 9/1968 |
| ES | 460194 | 5/1978 |
| ES | 283331 | 5/1985 |
| ES | 00 06854 | 12/1991 |
| ES | 1019585 | 1/1992 |
| ES | 2168045 | 5/2002 |
| FI | 843060 | 8/1984 |
| FR | 1293043 | 4/1962 |
| FR | 2691491 | 11/1983 |
| FR | 2 568295 | 5/1986 |
| FR | 2623544 | 5/1989 |
| FR | 2 630149 | 10/1989 |
| FR | 26379232 | 4/1990 |
| FR | 2675174 | 10/1991 |
| FR | 2667639 | 4/1992 |
| FR | 2691491 | 11/1993 |
| FR | 2697275 | 4/1994 |
| FR | 2712329 | 5/1995 |
| FR | 2776956 | 10/1999 |
| FR | 2781513 | 1/2000 |
| FR | 2785633 | 5/2000 |
| GB | 424057 | 2/1935 |
| GB | 585205 | 1/1947 |
| GB | 599793 | 3/1948 |
| GB | 636423 | 4/1950 |
| GB | 812671 | 4/1959 |
| GB | 1033866 | 6/1966 |
| GB | 1034117 | 6/1966 |
| GB | 1044846 | 10/1966 |
| GB | 1237744 | 6/1968 |
| GB | 1127915 | 9/1968 |
| GB | 1275511 | 5/1972 |
| GB | 1 399402 | 7/1975 |
| GB | 1399402 | 7/1975 |
| GB | 1430423 | 3/1976 |
| GB | 2 117813 | 10/1983 |
| GB | 2117813 | 10/1983 |
| GB | 2126106 | 3/1984 |
| GB | 2152063 | 7/1985 |
| GB | 2238660 | 6/1991 |
| GB | 2243381 | 10/1991 |
| GB | 2256023 | 11/1992 |
| JP | 54-65528 | 5/1979 |
| JP | 57-119056 | 7/1982 |
| JP | 59-186336 | 10/1984 |
| JP | 3-169967 | 7/1991 |
| JP | 4-106264 | 4/1992 |
| JP | 5-148984 | 6/1993 |

| | | | |
|---|---|---|---|
| JP | 6-56310 | | 5/1994 |
| JP | 6-146553 | | 5/1994 |
| JP | 6-200611 | | 7/1994 |
| JP | 6-320510 | | 11/1994 |
| JP | 7-76923 | | 3/1995 |
| JP | 7-180333 | | 7/1995 |
| JP | 7-300979 | | 11/1995 |
| JP | 7-310426 | | 11/1995 |
| JP | 8-109734 | | 4/1996 |
| JP | 8-270193 | | 10/1996 |
| JP | 2001181432 | * | 7/2001 |
| NE | 7601773 | | 2/1976 |
| NO | 157871 | | 2/1988 |
| NO | 305614 | | 6/1999 |
| RU | 363795 | | 12/1972 |
| SE | 711 4900-9 | | 9/1974 |
| SE | 450411 | | 6/1987 |
| SE | 450141 | | 9/1987 |
| SE | 501014 | | 10/1994 |
| SE | 501914 | | 6/1995 |
| SE | 502994 | | 4/1996 |
| SE | 506254 | | 11/1997 |
| SE | 509059 | | 11/1998 |
| SE | 509060 | | 11/1998 |
| SE | 512290 | | 2/2000 |
| SE | 512313 | | 2/2000 |
| SE | 0000200-6 | | 8/2001 |
| WO | 84/02155 | | 6/1984 |
| WO | 87/03839 | | 7/1987 |
| WO | 89/08539 | | 9/1989 |
| WO | 92/17657 | | 10/1992 |
| WO | 93/13280 | | 7/1993 |
| WO | 93/19910 | | 10/1993 |
| WO | 94/01628 | | 1/1994 |
| WO | 94 26999 | | 11/1994 |
| WO | 94/26999 | | 11/1994 |
| WO | 95/06176 | | 3/1995 |
| WO | 96/27719 | | 9/1996 |
| WO | 96/27721 | | 9/1996 |
| WO | 96/30177 | | 10/1996 |
| WO | 97/47834 | | 12/1997 |
| WO | 98/24495 | | 6/1998 |
| WO | 98/24994 | | 6/1998 |
| WO | 98/38401 | | 9/1998 |
| WO | 99 40273 | | 8/1999 |
| WO | 99/66151 | | 12/1999 |
| WO | 99 66152 | | 12/1999 |
| WO | 00 06854 | | 2/2000 |
| WO | 00 66856 | | 11/2000 |
| WO | 01 66876 | | 9/2001 |

OTHER PUBLICATIONS

Opposition II EPO. 698. 162—Facts—Arguments Evidence (11 pages)—translation.

U.S. Court of Appeals for the Federal Circuit, 02-1222-1291 *Alloc, Inc.* vs. *International Trade Commission*, pp. 1-32.

U.S. Court of Appeals for the Federal Circuit Decision in *Alloc, Inc. et al.* vs. *International Trade Commission and Pergs, Inc. et al.* decided Sep. 10, 2003.

* cited by examiner

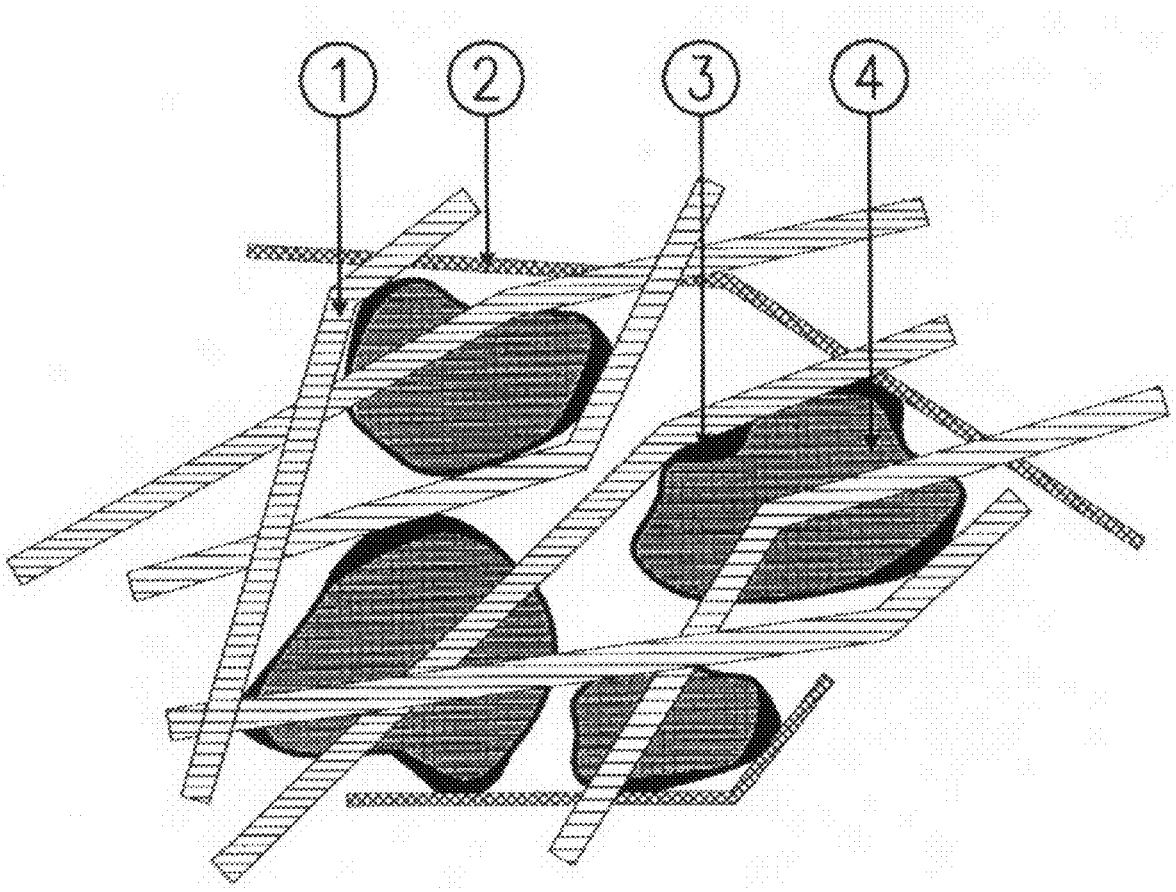
1
2
3
4

INSULATION BOARD MADE OF A MIXTURE OF WOOD BASE MATERIAL AND BINDING FIBERS

CROSS REFERENCE TO RELATED APPLICATIONS

This application is a continuation of U.S. patent application Ser. No. 11/076,044, filed Mar. 10, 2005, now U.S. Pat. No. 7,550,202 and claims priority under 35 U.S.C. §119 to German Application No. 10 2004 011 931.7, filed Mar. 11, 2004, the disclosures of which are expressly incorporated by reference herein in their entirety.

BACKGROUND OF INVENTION

1. Field of the Invention

The invention relates to an insulation material board composed of wood material/binder fiber mixture, to a method for producing an insulation material board and to an additive for improving the compressive strength and improving the structure of insulation material boards composed of a wood material/binder fiber mixture.

2. Background Description

The invention relates to an insulation material board composed of wood material/binder fiber mixture, to a method for producing an insulation material board and to an additive for improving the compressive strength and improving the structure of insulation material boards composed of a wood material/binder fiber mixture.

The production of insulation materials from fibers, for example fibers of wood, of flax, of hemp or of wool or the like, if appropriate with the addition of thermo-plastic binder fibers, is known. The production of these insulation materials and fleeces is carried out by the dry method, for example by means of aerodynamic fleece folding methods with a spatial orientation of the fiber/binder fiber matrix in a drum opening and distributing the fiber stock and with a subsequent thermal consolidation of the fiber/binder fiber matrix in a hot-air throughflow dryer. This is described, for example in DE 100 56 829 A1.

Where wood fiber insulation materials are concerned, the production of the insulation materials boards may also be carried out by the wet method with a subsequent hot-pressing method.

In the previous methods for the production of insulation materials from natural and synthetic fibers, there is still often an insufficient spatial orientation of the wood fibers and binder fibers. On account of the predominantly parallel orientation of the fibers, these insulation material boards can easily be split perpendicularly to the surfaces of the board in spite of thermal consolidation in the hot-air throughflow dryer. Moreover, the compressive strength of these insulation material boards is relatively low because of the low bulk density.

The result of this is that the use of such boards as insulation material and plaster base, particularly on the outside, presents problems, since the insulation materials having low compressive strength and low transverse tensile strength have to be fastened to the substrate by special fastening means. Moreover, too low a compressive strength has an adverse effect on the impact resistance of the composite heat insulation system.

To achieve a sufficient structural strength of the insulation material board, binder fibers are used, which, as a rule, consist of a polyester or of a polypropylene core with thicknesses of 2.2 to 4.4 detex in which are added in a proportion of up to 25 percent by weight. Since the costs of these binder fibers are relatively high in comparison with wood fibers, such insulation materials are comparatively costly. Furthermore, the addition of binder fibers has only a limited improving effect in increasing the compressive strength. An optimum bulk density for a wood fiber board as a plaster base board is approximately 100 kg/m$^3$. Higher bulk densities have an adverse effect on the thermal conductivity of the insulation plate, in such a way that the required thermal conductivity group WLG 040 is not achieved, but, on the other hand, increased stability is achieved.

SUMMARY OF THE INVENTION

The object of the present invention is to provide an insulation material board, an additive for an insulation material board and a method for producing an insulation material board, by means of which the compressive strength and structural strength of insulation material boards composed of wood materials, in particular of wood fibers, with low bulk densities can be increased cost-effectively.

This object is achieved, according to the invention, by means of an insulation material board which is composed of a wood material/binder fiber mixture and in which an additive composed of a thermally resistant core is added to the mixture, the core being provided with a thermally activatable coating.

Advantageously, the core consists of perlite or of a thermosetting plastic material, thus resulting in an improvement in the moisture resistance of the insulation material board on account of the hydrophobic properties of the additive. This arises due to a mass of hydrophilic wood materials, in particular wood fibers, which is reduced according to the addition of the additive.

Furthermore, there is provision for the core to take the form of granulate or of a fiber material, in order to come into contact with as many wood material components or wood fibers and also binder fibers as possible.

To increase the compressive strength and transverse tensile strength, the dry wood fiber/binder fiber mixture has added to it a fine-grained granulate or fine-grained particles composed of bituminized perlite, of different thermoplastic groups, of thermoplastically encased thermosetting plastic groups or of comparable particles with a thermally resistant core and with a thermally activatable or thermoplastic casing. The grain sizes of the additives are in this case between 0.3 and 2.5 mm.

To increase the compressive and structural strength, the proportion of the additive in relation to the overall mass of the wood material/binder fiber mixture is at least 20%, but may even be 40% or more.

Advantageously, the additive is distributed homogeneously within the wood material/binder fiber mixture, in order to ensure a uniform compressive and structural strength of the insulation material board.

In contrast to the hydrophilic wood materials, there is provision for the additive to be hydrophobic, so that a higher moisture resistance of the insulation material board is achieved in addition to the improved compressive strength.

The insulation material board preferably has a bulk density of more than 20 kg/m$^3$, but may even have a bulk density of above 100 kg/m$^3$, in order to have, on the one hand, optimum strength and, on the other hand, optimum thermal conductivity, so that, when it is used as a stable plaster base, good insulation is ensured.

By the additive being used, the proportion of the binder fibers can be reduced to approximately 10 percent by weight in relation to the overall mass of the insulation material board, thus reducing the costs of the insulation material board.

The additive according to the invention for improving the compressive strength and improving the structure of insulation material boards composed of a wood material/binder fiber mixture provides a thermally resistant core and a thermally activatable coating, so that both the wood materials and the binder fibers can be connected to the additive by the supply of energy. The supply of heat takes place, for example, by means of a hot-air throughflow dryer, hot-steam throughflow or HF heating. Other heating possibilities are likewise provided, for example by means of heated press plates.

The thermally activatable coating is preferably a thermoplastic or bitumen, and other thermally activatable coatings may likewise be arranged on a corresponding core, in order bring about a cross-linking of the wood materials and binder fibers with the additive.

The coating may surround the core completely, but alternatively only a partial coating of the surface of the core is provided.

The core consists of a granulate, for example of perlite or of another mineral basic material or of a fiber, while, alternatively to a mineral material, the core may also consist of a thermosetting plastic. It is likewise possible, in coordination with the process management, to employ a thermoplastic which remains dimensionally stable at the prevailing temperatures.

Advantageously, the additive may be a mixed plastic which, in addition to thermosetting plastic fractions, also has thermoplastic fractions. Mixed plastics of this type are, for example, products of the Dual System (DS) with average fractions of 50 to 70% polyolefins, 15 to 20% polystyrene, 5 to 15% PET and 1 to 5% of other packaging plastics. Such mixed plastics are produced by dry preparation methods, in particular mixed plastics from household garbage being used. The initial material is first comminuted in a comminution stage, magnetic substances are removed from the comminuted material, and the comminuted material is thermally agglomerated or compacted under pressure, that is to say press-agglomerated. During the agglomerating operation, volatile substances, water vapor, ash and paper can be suction-extracted by means of suction extraction devices.

The agglomerated material is subsequently dried to a desired residual moisture and screened. As a result of the agglomeration process, thermoplastic constituents, for example polyethylene (LDPE, HDPE) and thermosetting plastic constituents, for example polyesters or polyurethanes, are connected to form a granulate-like material. In this case, a thermosetting core composed, for example, of polyurethane is surrounded completely or partially by a thermally activatable thermoplastic casing composed, for example, of polyethylene, or a thermoplastic core melting at high temperatures is surrounded by a casing melting at low temperatures.

Mixed plastics agglomerated in this way have a sufficiently high proportion of thermally activatable (thermoplastic) fractions and of thermosetting constituents and are therefore particularly suitable as an additive for improving the compressive strength and improving the structure and/or as a binder for an insulation material board, since the thermoplastic casing of the additive can be thermally activated by means of the supply of sufficient temperature, for example in a hot-pressing operation. Advantageously, mixed plastics agglomerated in this way can be added to wood material fibers and known binder fibers on insulation material production lines, since the agglomerated mixed plastics have thermally activatable constituents which are activated by pressure and temperature for the production of insulation material boards, the thermosetting cores or the thermoplastic cores remaining stable. For this purpose, the press temperature is to be set in such a way that it is always lower than the melting temperature or the decomposition temperature of the core materials.

By agglomerated mixed plastic being added to the production of the insulation material boards, improved compressive strength and transverse tensile strength values of the boards can be achieved, without the proportion of costly binder fibers (with a polypropylene core and a polyethylene casing) having to be increased. Advantageously, the increase in the strength properties is possible solely by the addition of cost-effective agglomerated mixed plastics which originate from the Dual System.

The additive is hydrophobic, in order to improve moisture resistance.

In the method for producing an insulation material board with a wood material/binder fiber mixture, an additive with a thermally resistant core and with a thermally activatable coating is added to the mixture. The thermally activatable coating is activated by the supply of heat, so that the wood material/binder fiber mixture and the additive are cross-linked with one another. An insulation material board is thereby provided, which comes within the optimum bulk density range of approximately 100 kg/m$^3$ and in this case has sufficient compressive strength and transverse tensile strength, at the same time with moisture resistance.

The coating of the core is in this case activated in a hot-air stream, although alternative activation methods, for example by heated rollers, HF heating or infrared emitters, are likewise possible.

For the uniform intermixing of the wood materials and of the binder fibers, these are mixed in an aerodynamic fleece forming machine, and the additive is subsequently admixed in a separate fleece forming machine. In this case, the spatial orientation of the fiber matrix is also carried out, this taking place in a separate aerodynamic fleece forming machine.

A uniform formation of the structure of the insulation material board is carried out by means of a homogeneous distribution of the additive within the wood material/binder fiber mixture.

BRIEF DESCRIPTION OF THE DRAWINGS

The invention is explained in more detail below with reference to the single FIGURE.

The FIGURE shows the embedding of an additive into a wood fiber/binder fiber matrix.

DETAILED DESCRIPTION OF EMBODIMENTS OF THE INVENTION

The FIGURE illustrates a mixture of wood fibers 1 and of binder fibers 2 which are intermixed homogeneously in a first aerodynamic fleece forming machine. Alternatively to wood fibers 1, other wood materials, for example wood chips or the like, may also be used, for example also alternative raw materials, such as hemp, wool, flax or other renewable raw materials.

An admixing of an improving additive subsequently takes place, the latter consisting of a core 4 with a thermally activatable coating 3. This thermally activatable coating 3 may consist, for example, of bitumen or of a thermoplastic. This coating 3 may either surround the core 4 completely or be arranged only partially on the surface of the latter.

The additive 3, 4 is added to the dry mixture of wood fibers 1 and of binder fibers 2 as a fine-grained granulate or as particles composed of corresponding materials, such as bituminized perlites, coated thermo-plastic groups or thermoplastically encased thermo-setting groups. The grain sizes of the additive 3, 4 should be 0.3-2.5 mm, preferably 0.5-2 mm, for this intended use. To increase the compressive or structural strength, the proportion of the additive in the overall mass of the insulation board should be at least 20%, but even values of above 40% are possible.

The admixing of the additive 3, 4 and the spatial orientation of the fiber matrix take place, after the intermixing of the wood fibers 1 and binder fibers 2, in a separate second aerodynamic fleece forming machine. Owing to the addition of the additive 3, 4 along with the additional connecting action of the thermally activatable coating 3, the proportion of binder fibers 2 in the overall weight can be lowered to 10%.

Owing to the aerodynamic fleece or fiber folding method with spatial orientation, the particles of the additive 3, 4 are distributed homogeneously within the matrix of the wood fibers and binder fibers 1, 2. Activation advantageously takes place in a hot-air throughflow dryer, so that, as a result of the heat supplied to the thermoplastic casings 3 of the core 4, the additive particles form additional contact points with the wood fibers 1 and with the binder fibers 2. A fiber/binder additive matrix having compressive strength and improved structural strength is thereby provided.

The insulation materials improved by means of the additive 3, 4 may be employed as heat insulation material on the outside, for example for composite heat insulation systems and as impact sound insulation materials in the floor area, for example under laminate or finished parquet floors.

Example 1

Heat insulation material board for heat insulation with a target bulk density of 100 kg/m$^3$ and with a thickness of 100 mm by the addition of the additive.

Apparent density overall 10.056 g m$^2$, proportion of the additive composed of various thermoplastic groups 3.394 g/m$^2$ (proportion 60% in relation to absolutely dry wood fibers), proportion of the binder fiber 1.006 g/m$^2$ (10%), proportion of wood fibers 5.656 g/m$^2$, intermixing and folding of the fiber fleece in a drum, activation of the thermoplastic constituent in a hot-air throughflow dryer at 170° C.

Example 2

Insulation material board for impact sound insulation, target bulk density 135 kg/m$^3$ and with a thickness of 6 mm by the addition of the additive:

Apparent density overall 800 g/m$^2$, proportion of the additive composed of various thermoplastic groups 206 g/m$^2$ (proportion 40% in relation to absolutely dry wood fibers), proportion of the binder fiber 80 g/m$^2$ (10%), proportion of wood fibers 514 g/m$^2$, intermixing and folding of the fiber fleece in a drum, activation of the thermoplastic constituents in a hot-air throughflow dryer at 170° C.

What is claimed is:

1. An insulation material board composed of a wood material/binder mixture, comprising an additive having thermosetting and thermoplastic portions, wherein the thermosetting portion is a thermosetting plastic that forms a core and the thermoplastic portion forms a thermally activatable coating that at least partially encloses the core, wherein the additive is an agglomerate of plastics, wherein the agglomerate of plastics include an average fraction of polyolefins of 50% to 70%, polystyrene of 15% to 20%, PET of 5% to 15% and other packing plastics of 1% to 5%.

2. The insulation board of claim 1, wherein the wood material comprises wood fibers.

3. The insulation board of claim 1, wherein the additive has a granulate form.

4. The insulation board of claim 1, wherein magnetic substances have been removed from the additive.

5. The insulation board of claim 4, wherein volatile substances, water vapor, ash, and paper have been suction-extracted from the additive.

6. The insulation board of claim 1, wherein:

the thermosetting core comprises polyurethane; and the thermoplastic portion comprises polyethylene.

7. The insulation board of claim 1, wherein a proportion of the additive in relation to an overall mass of the insulation board is at least 20%.

8. The insulation board of claim 1, wherein the additive is hydrophobic.

9. The insulation board of claim 1, wherein the additive has a grain size of 0.3 to 2.5 mm.

10. An insulation board, comprising:

a mixture of wood fibers and binder fibers; and an additive distributed homogeneously within the mixture of wood fibers and binder fibers;

wherein the additive comprises an agglomerate of mixed plastics;

the additive comprises a thermosetting core and a thermoplastic portion that forms a thermally activatable coating that at least partially encloses the core; and the additive has a granulate form, wherein:

the agglomerate of mixed plastics includes an average fraction of polyolefins of 50% to 70%, polystyrene of 15% to 20%, PET of 5% to 15% and other packing plastics of 1% to 5%;

magnetic substances have been removed from the additive;

volatile substances, water vapor, ash, and paper have been suction-extracted from the additive;

a proportion of the additive in relation to an overall mass of the insulation board is at least 20%;

the additive is hydrophobic; and the additive has a grain size of 0.3 to 2.5 mm.

* * * * *